US007891226B2

(12) United States Patent
Seo

(10) Patent No.: US 7,891,226 B2
(45) Date of Patent: Feb. 22, 2011

(54) ELECTROMAGNETIC BLANK RESTRAINER

(75) Inventor: Young Seo, Ann Arbor, MI (US)

(73) Assignee: Enview Technologies, LLC, Montpelier, OH (US)

( * ) Notice: Subject to any disclaimer, the term of this patent is extended or adjusted under 35 U.S.C. 154(b) by 611 days.

(21) Appl. No.: 10/591,683

(22) PCT Filed: Mar. 4, 2005

(86) PCT No.: PCT/US2005/006933

§ 371 (c)(1),
(2), (4) Date: Sep. 5, 2006

(87) PCT Pub. No.: WO2005/091954

PCT Pub. Date: Oct. 6, 2005

(65) Prior Publication Data

US 2007/0186617 A1 Aug. 16, 2007

Related U.S. Application Data

(60) Provisional application No. 60/551,169, filed on Mar. 8, 2004.

(51) Int. Cl.
*B21D 22/21* (2006.01)
*B21C 1/02* (2006.01)
*B25B 11/00* (2006.01)

(52) U.S. Cl. ..... 72/350; 72/707; 269/8

(58) Field of Classification Search ..... 72/350, 72/351, 430, 707, 54, 56; 269/8
See application file for complete search history.

(56) References Cited

U.S. PATENT DOCUMENTS 3,670,554 A 6/1972 Kienzler et al.
3,673,840 A 7/1972 Tselikov et al.
4,080,819 A 3/1978 Hook et al.
4,086,798 A 5/1978 Lemmo
4,357,821 A 11/1982 Fowler
4,404,829 A 9/1983 Dorakovski
4,404,837 A 9/1983 Allen et al.
4,471,687 A 9/1984 Nightingale et al.
4,584,859 A 4/1986 Saunders
4,805,439 A 2/1989 Kobayashi et al.
4,912,959 A 4/1990 Bond
5,129,252 A 7/1992 Hahn et al.
5,212,977 A * 5/1993 Stuart ..... 72/347
5,257,523 A 11/1993 Hahn et al.
5,271,259 A 12/1993 Miller et al.
5,307,665 A 5/1994 Stuart
5,325,699 A 7/1994 Stuart
5,357,779 A * 10/1994 Hahn et al. ..... 72/347
5,377,520 A * 1/1995 Thoms et al. ..... 72/361
5,507,166 A 4/1996 Orlick et al.

(Continued)

FOREIGN PATENT DOCUMENTS

JP 01186225 A * 7/1989

*Primary Examiner*—Debra M Sullivan
(74) *Attorney, Agent, or Firm*—Fraser Clemens Martin & Miller LLC; J. Douglas Miller

(57) ABSTRACT

Apparatus for forming an article from a blank of sheet metal including electromagnet field producing means disposed adjacent a die cavity for selectively energizing the field producing means for restraining movement of the blank during the forming thereof.

4 Claims, 3 Drawing Sheets

U.S. PATENT DOCUMENTS 5,590,558 A 1/1997 Saunders et al.
5,689,992 A 11/1997 Saunders et al.
5,775,160 A 7/1998 Fleischer et al.
5,941,110 A 8/1999 Cao et al.

* cited by examiner

ELECTROMAGNETIC BLANK RESTRAINER

CROSS-REFERENCE TO RELATED APPLICATION

This application claims the benefit of U.S. Provisional patent application 60/551,169, filed Mar. 8, 2004.

BACKGROUND OF THE INVENTION

1. Field of the Invention

The invention relates to sheet metal stamping operations and more particularly to an electromagnetic means for restraining the blank of sheet metal during a metal forming operation.

2. Description of the Prior Art

Sheet metal forming processes are typically employed in industries such as for example automotive, appliances, military, and electronics. The elimination of defects during the sheet metal forming process has been the subject of considerable study. The defects which typically occur during the forming process include thinning and tearing, plastic buckling or wrinkling, and elastic recovery or spring back upon unloading. Certain of these defects can be effectively minimized by controlling the blankholder or binder force and drawbead penetration which relate to the restraining forces applied to the sheet metal blank during a metal forming operation. By controlling and/or varying the blankholder force (BHF) during the sheet metal forming operation, certain defects can be eliminated and the formability of the product can be improved.

It has been found that by improved blankholder force application to the sheet metal blank being formed, better control of wrinkling and fracturing of the metal can be achieved. Also, it has been found that improved thickness profiles and reduced springback are effected. However, the conventional stamping presses, either mechanical or hydraulic, are generally equipped with nitrogen gas springs or hydraulic cushions as the means to exert the blankholder force, are seldom retrofitted to control the force due to the limited space available in the press and the complexity of the required hydraulic system.

It is an objective of the present invention to produce an electromagnetic blank restrainer which will overcome the shortcomings of the prior blank restraining systems.

Another objective of the invention is to produce an electromagnetic blank restrainer utilizing the benefits of variable blank holding forces created by the utilization of electromagnetic forces, either attraction or repulsion, to restrain the blank of sheet metal during a forming process of the sheet metal.

Still another objective of the invention is to produce an electromagnetic blank restrainer for applying variable forces created by a plurality of cooperating magnetic components to control the forces acting to restrain the blank of sheet metal during a stamping operation to form the blank into a stamped part.

SUMMARY OF THE INVENTION

The above objectives and advantages of the invention may typically be achieved by an apparatus for forming an article from a blank of sheet metal comprising a first die member having a cavity formed therein, a plurality of electromagnets disposed in spaced relation about the cavity in the die for restraining movement of the blank of sheet metal; a second die member mounted for reciprocal movement toward and away from the cavity formed in the first die member; means for imparting selective reciprocal movement of the second die member; and control means for selectively energizing the plurality of electromagnets to restrain movement of the blank of sheet metal during the reciprocal movement of the second die.

BRIEF DESCRIPTION OF THE DRAWINGS

The objects and advantages of the invention will become readily apparent to one skilled in the art by reading the following detailed description of a preferred embodiment of the invention when considered in the light of the accompany drawings, in which.

DETAILED DESCRIPTION OF THE PREFERRED EMBODIMENTS

Figure 1:
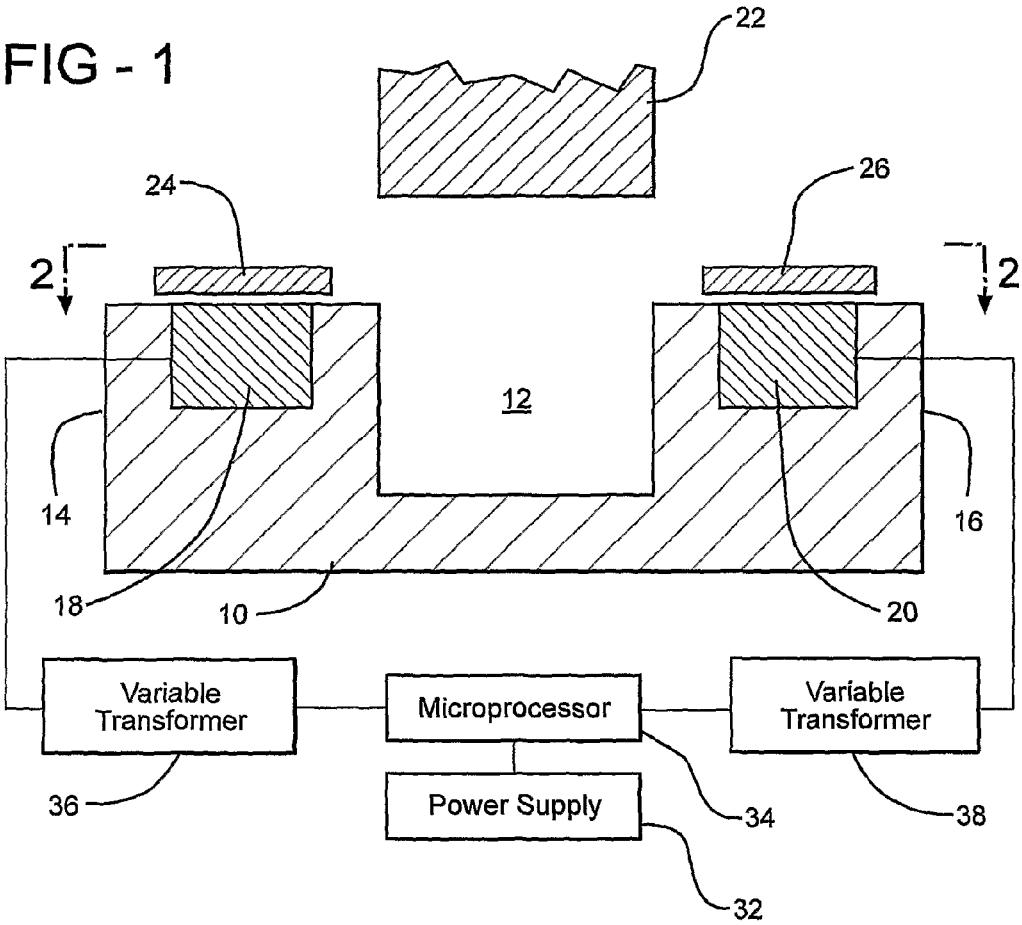
FIG. 1 is a diagrammatic cross sectional view of an electromagnetic blank restrainer incorporating the novel features of the present invention.

Attractive force on magnetic materials, as well as repulsive force on non-magnetic materials created by electromagnetic field, are the intrinsic properties of electromagnetism adopted in the electromagnetic blank restrainer of the invention which is designed to exert on the magnetic blank a restraining force that is conventionally exerted by solid blankholder and drawbeads. Because of the compact size and inexpensive manufacturing cost, the restrainer can replace or collaborate with bulky and expensive blankholders of the prior art. The cost will be only a fraction of the current blankholders cost and, at the same time, the fabrication or tooling labors and hours can be tremendously reduced.

The same benefits of the prior art systems can be achieved with the invention while replacing the hydraulic control system with swift and accurate electronic control devices, which provides more flexibility and functionality only by varying the input of the energizing power. The control system of the invention is more accurate and prompt because the response time of current is swifter than that of hydraulic fluid, the system is fully automated with desired control schemes. When it is used to replace the drawbeads, the present invention eliminates the plastic deformation which occurs with the use of drawbeads while preserving the ductility of sheet metal blank before it enters a die. The size of the blank is reduced resulting in material savings since it is possible to eliminate the flange area typically dented by drawbeads after forming.

Referring to FIGS. 1, 2, 3, and 4, there is illustrated an electromagnetic blank restrainer incorporating the features of the present invention. The blank restrainer includes a female die member having a main body 10 provided with a cavity 12 defined by two spaced apart upstanding portions 14 and 16. The upstanding portions 14 and 16 are provided with electromagnets 18 and 20, respectively. The electromagnets 18 and 20 are typically formed of a magnetic alloy preferably having the desired magnetic strength and utilizing low energy consumption. Although the embodiment shown includes two electromagnets 18 and 20, it must be understood that additional electromagnets could be used in certain instances. The electromagnets 18 and 20 are embedded within the female die member as generally illustrated in the drawings.

A male die member 22 is provided for controlled reciprocating movement into and out of the female cavity 12. Suitable control means is typically provided to impart the desires reciprocal movement of the male die toward and away the die 10.

Armature members 24 and 26 are disposed in spaced relation above the electromagnets 18 and 20, respectively. The members 24 and 26 are typically formed of a material having high permeability to magnetic fields and magnetic flux. In use, the members 24 and 26 cooperate with the respective electromagnets 18 and 20 and function to concentrate the magnetic fields produced by the electromagnets. Means may be provided to vary the spacing between the members 24 and 26, and the respective electromagnets 18 and 20 to accommodate workpieces or blanks of varying thicknesses.

Figure 2:
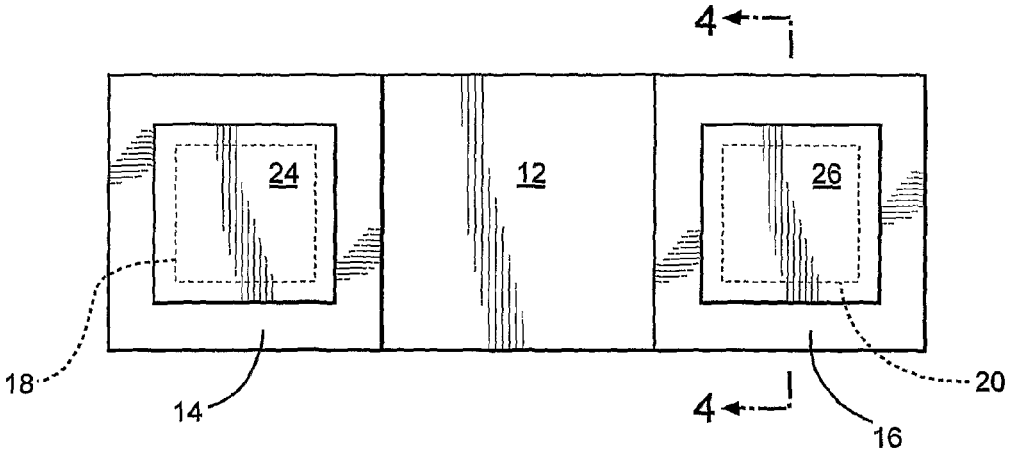
FIG. 2 is a top plan view of the restrainer illustrated in FIG. 1 taken along line 2-2 thereof.
Figure 3:
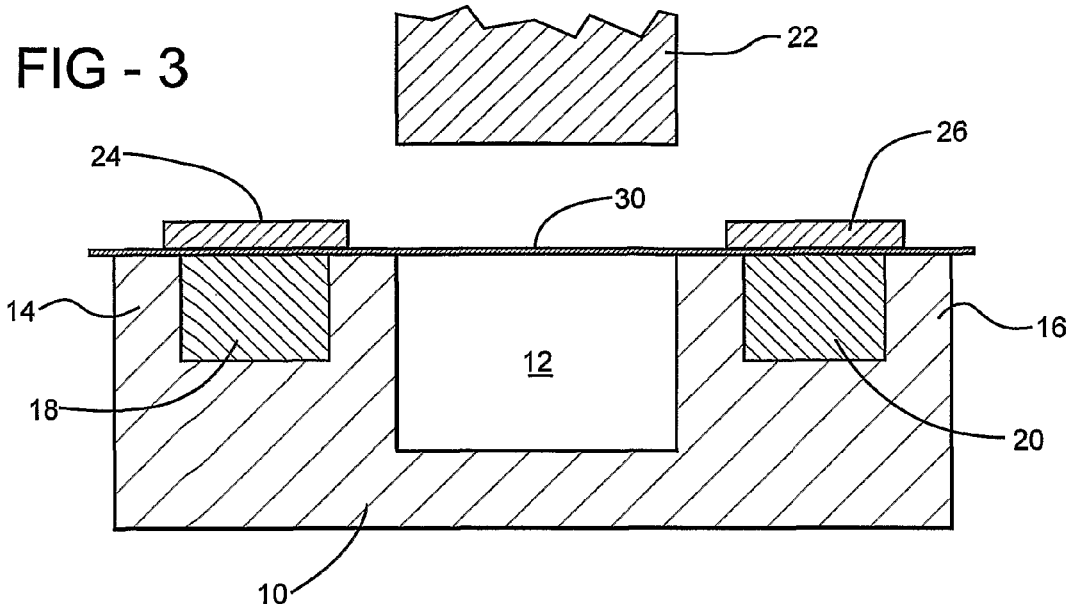
FIG. 3 is a view similar to FIG. 1, showing the disposition of a blank of sheet material to be formed.
Figure 4:
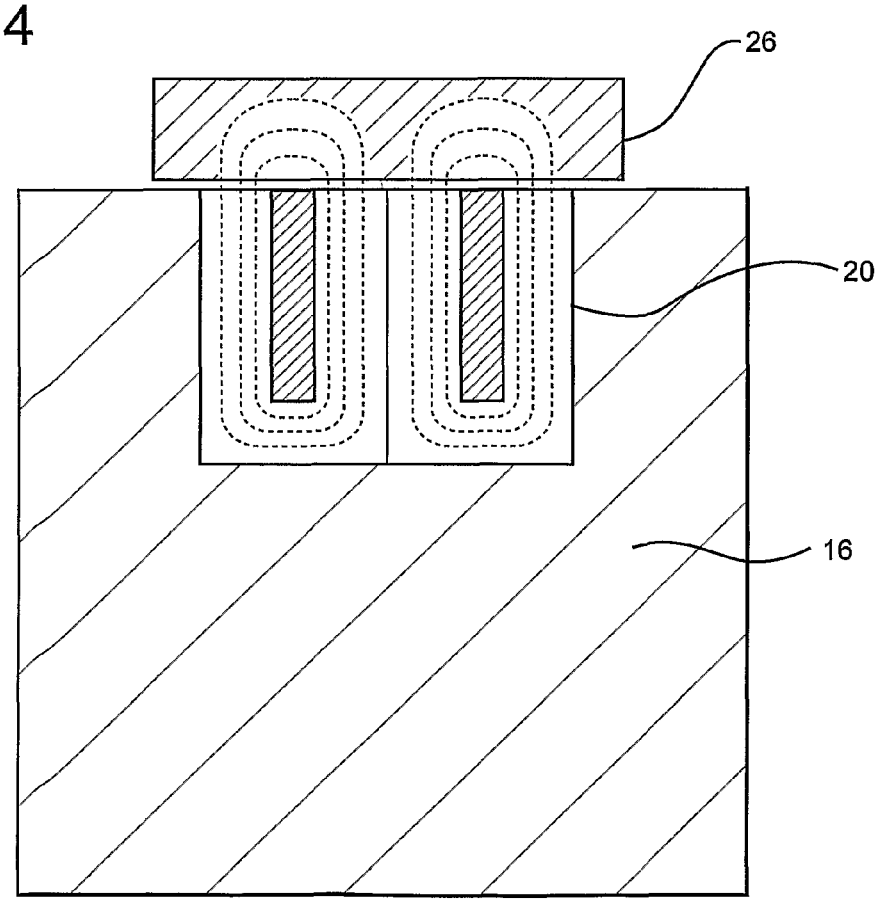
FIG. 4 is an enlarged fragmentary view of the magnetic flux lines produced by the structure illustrated in FIGS. 1, 2, and 3.

FIG. 3 illustrates the features of the invention illustrated in FIGS. 1 and 2 and further shows the interdigitation of a workpiece or metal blank 30 between the upper surfaces of the electromagnets 18 and 20 and the lower surfaces of the respective armature members 24 and 26.

The energization of the electromagnets 18 and 20 is typically achieved through the utilization of a variable source of electrical energy. The energization system is illustrated in schematic form in FIG. 1. More specifically, the energization system includes a power supply 32 which is coupled to the coils of the electromagnets 18 and 20 through a computer or microprocessor 34. The output of the microprocessor 34 is coupled, in turn, to variable transformers 36 and 38 and thence to the respective electromagnet 18 and 20. With such a system, the magnetic field produced by the electromagnets 18 and 20 may be individually energized in accordance with the blank or workpiece being processed.

A typical magnetic flux pattern produced by the electromagnets mentioned above is diagrammatically illustrated in FIG. 4. The magnetic flux lines which denote the magnetic field produced by the electromagnets is illustrated in the dashed lines. It will be noted that the function of the armature 26 is to concentrate the magnetic field as illustrated.

The flux or magnetic field strength can be selectively chosen by proper control of the electrical system including the microprocessor.

It will be appreciated that the workpiece 30 is held by the electromagnets 18 and 20. The electromagnets 18 and 20, through the selective energization thereof, are effective to control the movement of the workpiece 30 during the drawing of the workpiece to form a desired shape. The illustrations and description disclose the use of an electromagnetic blank restrainer in lieu of the conventional blankholder in connection with the forming by a stamping operation of a sheet metal workpiece.

Figure 5:
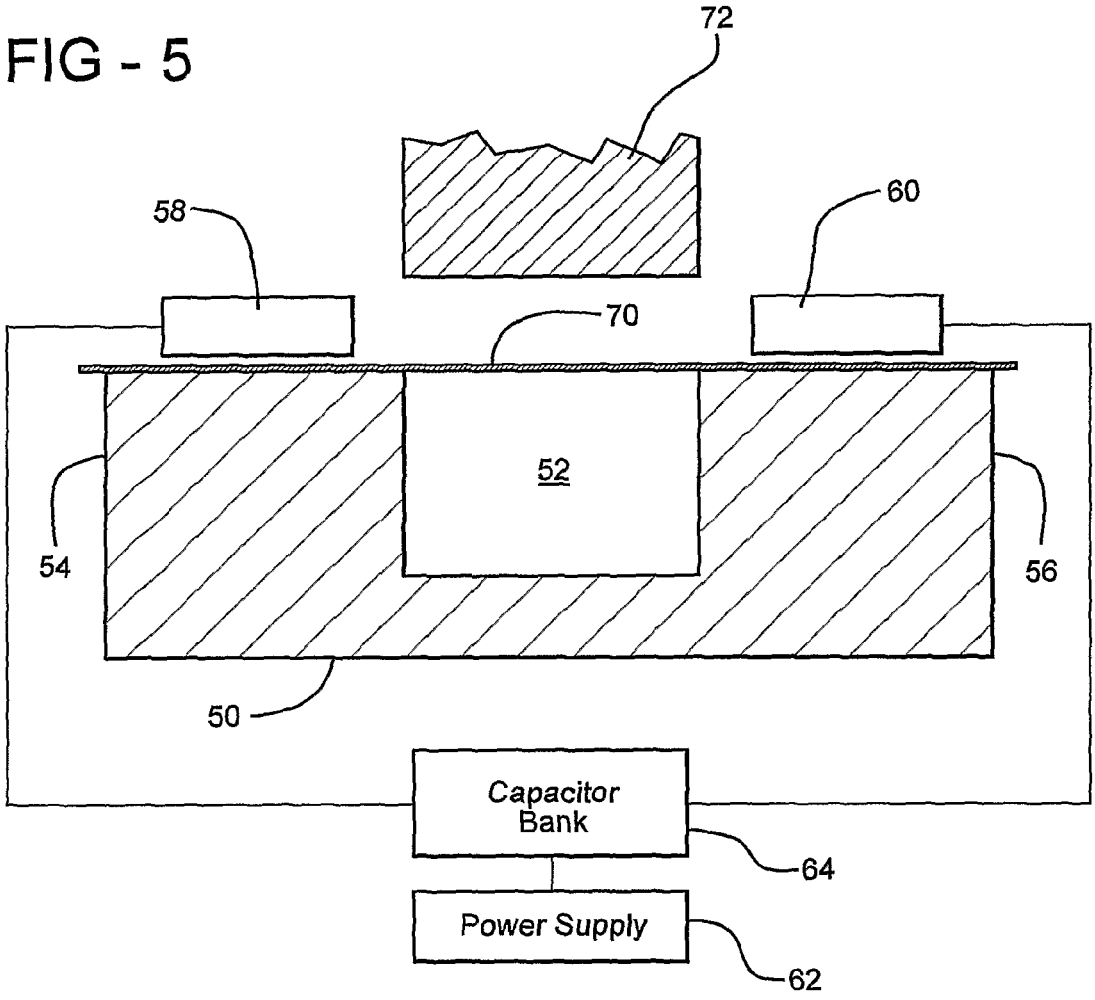
FIG. 5 is an alternative embodiment of the invention illustrated in FIGS. 1, 2, 3, and 4 showing an electromagnetic blank for use with a non-magnetic blank or workpiece to be formed.

The attracting forces are generally considered when dealing with electromagnetic restraining devices. However, the repelling forces are also considered to be important. An example is illustrated in FIG. 5 wherein there is disclosed a female die member 50 provided with a cavity 52 defined by two spaced apart upstanding portions 54 and 56. The die member 50 is formed of a magnetic material, such as tool steel, for example. Electrically energized coils 58 and 60 are disposed in spaced apart relations from one another and from the adjacent surfaces of the female die member 50.

The coils 58 and 60 are energized by a time varying electrical current from a power supply 62 and a capacitor blank 64. A non-ferrous blank or workpiece 70 is interdigitated between the facing surfaces of the coils 58 and 60 and the respective upwardly facing surfaces of upstanding portions 54 and 56.

A male die member 72 is provided for controlled reciprocating movement into and out of the cavity 52. Suitable control means is typically provided to import the desired reciprocal movement and the male die member 72 toward and away from the die 50.

A typical example of a workpiece or blank 70 of non-ferrous material is aluminum or brass, for example.

By causing a time varying electrical current to pass through the coils 58 and 60, an eddy current is developed in the associated non-ferrous blank. The eddy current produced in the blank 70 results in repelling forces against the magnetic field created also by the coils 5*g* and 60. Thus, by proper fixturing, the non-ferrous blank can be restrained by the repulsive eddy current force generated by the product of magnetic field and eddy current caused to move into intimate pressure contact with the workpiece and this force will act to restrain movement of the workpiece 70 whether magnetic or non-magnetic.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. Apparatus for forming an article from a blank of sheet metal comprising:

a first die member having a cavity formed therein;

a second die member;

means for imparting relative reciprocal movement between the first die member and the second die member to deform the blank of sheet metal within the cavity of the first die member;

means for producing a magnetic field to exert magnetic restraining forces on the blank of sheet metal to selectively restrain relative movement between the blank of sheet metal and the first die member during the deformation of the blank of sheet metal, wherein the means for producing a magnetic field includes a plurality of electromagnets; and means for controlling the strength of the magnetic field to vary the magnetic restraining forces during the deformation of the blank of sheet metal, wherein the means for controlling the strength of the magnetic field includes a microprocessor for controlling the strength of the magnetic field produced by each of the electromagnets to provide different magnetic restraining forces at selected locations of the blank of sheet metal during the deformation of the blank of sheet metal.

2. The invention defined in claim 1 wherein the cavity includes an open end.

3. The invention defined in claim 2 wherein the electromagnets are disposed in spaced relation about the open end of the cavity of the first die member.

4. Method for forming an article from a blank of sheet metal including the steps of:

providing a first die member having a cavity formed therein;

disposing a plurality of electromagnets spaced about the cavity in the first die member to exert magnetic restraining forces on the blank of sheet metal for selectively restraining relative movement between the blank of sheet metal and the first die member;

positioning the blank of sheet metal over the cavity of the first die member;

providing a second die member;

providing means for imparting relative reciprocal movement between the first die member and the second die member to deform the blank of sheet metal; and varying the magnetic field of the electromagnets to provide selected magnetic restraining forces from each of the electromagnets during the deformation of the blank of sheet metal.

* * * * *